US011854726B2

(12) United States Patent
Takadate et al.

(10) Patent No.: US 11,854,726 B2
(45) Date of Patent: Dec. 26, 2023

(54) MAGNETIC BASE BODY CONTAINING METAL MAGNETIC PARTICLES COMPOSED MAINLY OF FE AND ELECTRONIC COMPONENT INCLUDING THE SAME

(71) Applicant: TAIYO YUDEN CO., LTD., Tokyo (JP)

(72) Inventors: Kinshiro Takadate, Tokyo (JP); Shinsuke Takeoka, Tokyo (JP)

(73) Assignee: TAIYO YUDEN CO., LTD., Tokyo (JP)

( * ) Notice: Subject to any disclaimer, the term of this patent is extended or adjusted under 35 U.S.C. 154(b) by 751 days.

(21) Appl. No.: 16/832,445

(22) Filed: Mar. 27, 2020

(65) Prior Publication Data

US 2020/0312498 A1 Oct. 1, 2020

(30) Foreign Application Priority Data

Mar. 29, 2019 (JP) ..... 2019-067302

(51) Int. Cl.

| | |
|---|---|
| ***H01F 1/38*** | (2006.01) |
| ***B22F 1/02*** | (2006.01) |
| ***H01F 1/147*** | (2006.01) |
| ***H01F 27/32*** | (2006.01) |
| ***H01F 41/02*** | (2006.01) |
| ***H01F 41/12*** | (2006.01) |
| ***H01F 27/255*** | (2006.01) |

(52) U.S. Cl.

CPC ..... *H01F 1/14766* (2013.01); *H01F 27/255* (2013.01); *H01F 27/32* (2013.01); *H01F 41/0206* (2013.01); *H01F 41/12* (2013.01)

(58) Field of Classification Search

None

See application file for complete search history.

(56) References Cited

U.S. PATENT DOCUMENTS

2019/0279802 A1* 9/2019 Yoshidome ..... H01F 1/24

FOREIGN PATENT DOCUMENTS

| | | |
|---|---|---|
| JP | 2009-164317 A | 7/2009 |
| JP | 2011-181654 A | 9/2011 |
| WO | 2017/047761 A1 | 3/2017 |

OTHER PUBLICATIONS

Machine translation of WO 2017047761A1. (Year: 2017).*

* cited by examiner

*Primary Examiner* — Xiaowei Su

(74) *Attorney, Agent, or Firm* — Pillsbury Winthrop Shaw Pittman, LLP

(57) ABSTRACT

A magnetic base body relating to one embodiment of the present invention includes a main body and an oxide film formed on the surface of the main body. The main body includes an oxide phase containing Si and a plurality of metal magnetic particles bound via the oxide phase. In the metal magnetic particles, Fe accounts for 98.5 wt % or more. When an XRD diffraction pattern of the magnetic base body is observed, a ratio Ia/Ib is 10 or more where Ia denotes an integrated intensity of peaks derived from the (220) plane of $Fe_2O_3$ and Ib denotes an integrated intensity of peaks derived from the (104) plane of $Fe_3O_4$.

7 Claims, 9 Drawing Sheets

MAGNETIC BASE BODY CONTAINING METAL MAGNETIC PARTICLES COMPOSED MAINLY OF FE AND ELECTRONIC COMPONENT INCLUDING THE SAME

CROSS-REFERENCE TO RELATED APPLICATIONS

This application is based on and claims the benefit of priority from Japanese Patent Application Serial No. 2019-067302 (filed on Mar. 29, 2019), the contents of which are hereby incorporated by reference in their entirety.

TECHNICAL FIELD

The present invention relates to a magnetic base body containing metal magnetic particles composed mainly of Fe and an electronic component including the same.

BACKGROUND

Various magnetic materials have been used as the material for a magnetic base body used in electronic components. Ferrite is often used as the magnetic material for coil components such as inductors. Ferrite is suitable as the magnetic material for an inductor because of its high magnetic permeability.

Other than ferrite, metal magnetic particles are also known as the magnetic material for electronic components. Since the metal magnetic particles have a higher saturation magnetic flux density than the ferrite material, they are suitable as the material for a magnetic base body of a coil component through which large current flows. A magnetic base body containing metal magnetic particles is produced in the following manner. A slurry is obtained by mixing and kneading the metal magnetic particles and a binder and poured into a mold, and pressure is applied to the slurry in the mold. In addition to this technique, there are other conventional methods of fabricating a magnetic base body containing metal magnetic particles. For example, a magnetic base body containing metal magnetic particles can be produced in the following manner. A slurry is produced by mixing and kneading together the metal magnetic particles and a binder, and a sheet of the slurry is applied onto a base body such as a PET film and dried to produce a sheet of the magnetic material. Such sheets of the magnetic material are stacked and pressure is applied to the stacked sheets of the magnetic material to bond the sheets together. Alternatively, a magnetic base body containing metal magnetic particles can be produced in such a manner that a slurry is obtained by mixing and kneading the metal magnetic particles and a binder, dried and broken into granulated powders, which are placed in a mold and subjected to pressure molding. The molded body obtained by the pressure molding may be thermally treated (sintered). The thermal treatment can form an oxide phase on the surface of the metal magnetic particles, and the oxide phase is used to bind the metal magnetic particles together.

In order to provide a magnetic base body with high magnetic permeability, metal magnetic particles composed mainly of Fe may be used. The metal magnetic particles composed mainly of Fe are soft. For this reason, such metal magnetic particles can easily achieve an improved filling rate in a magnetic base body when pressure molding is employed to fabricate the magnetic base body. The filling rate indicates the ratio of the metal magnetic particles in the magnetic base body. Here, although the surface of the magnetic base body is required to be electrically insulating, an electrically conductive oxide film is disadvantageously formed on the surface of the magnetic base body made of metal magnetic particles during the manufacturing process. In order to improve the insulating property of the surface of the magnetic base body, it has been known to perform surface treating that mechanically or chemically removes the conductive layer formed on the surface of the magnetic base body. For example, the surface treating method disclosed in Japanese Patent Application Publication No. 2011-181654 removes such a conductive layer by polishing the surface of the magnetic base body by 1 μm to 100 μm. According to the surface treating method disclosed in Japanese Patent Application Publication No. 2009-164317, the conductive layer is removed by subjecting the surface of the magnetic base body to pickling.

An insulating surface may be provided for a magnetic base body by preventing a conductive layer from being formed during the manufacturing process of the magnetic base body. International Publication No. 2017/047761 (The '761 Publication) discloses a magnetic base body fabricated from FeCrAl alloy particles. According to the disclosure of the '761 Publication, an insulating oxide film containing a Cr oxide and an Al oxide is formed on the surface of a magnetic base body containing FeCrAl alloy particles. Accordingly, the magnetic base body containing FeCrAl alloy particles has an insulating surface.

If pickling or polishing is employed to remove the conductive layer from the surface of the magnetic base body, the magnetic base body may be chemically or mechanically damaged. The damage may degrade the characteristics of the magnetic base body. Another disadvantage is an increased number of steps of the manufacturing process, which is attributed to more complicated manufacturing equipment for removing the conductive layer. For these reasons, it is desirable to prevent the conductive layer from being formed on the surface of the magnetic base body during the manufacturing process. On the surface of the magnetic base body disclosed in the '761 Publication, an insulating oxide film is formed during the manufacturing process. Accordingly, no surface treatment is necessary for the magnetic base body for the purposes of accomplishing higher insulating property. The magnetic base body disclosed in the '761 Publication is, however, made of FeCrAl alloy particles, which has a low Fe content of approximately 85 wt %. Therefore, the magnetic base body has a lower saturation magnetic flux density than a magnetic base body made of metal magnetic particles having a high Fe content. This poses a problem of low magnetic permeability when large current is injected into a coil.

SUMMARY

As is apparent from above, for a magnetic base body formed of metal magnetic particles having a high Fe content, it is desired to provide an insulating surface without the need of surface treatment such as pickling and polishing. One object of the present invention is to provide a highly insulating surface for a magnetic base body containing metal magnetic particles having a high Fe content. Other objects of the present invention will be made apparent through description in the entire specification.

A magnetic base body relating to one embodiment of the preset invention includes a main body and an oxide film formed on a surface of the main body. The main body includes an oxide phase containing Si and a plurality of metal magnetic particles bound via the oxide phase. In the metal magnetic particles, Fe accounts for 98.5 wt % or more. When an XRD diffraction pattern of the magnetic base body is observed, a ratio Ia/Ib is 10 or more where Ia denotes the integrated intensity of the peaks derived from the (220) plane of $Fe_2O_3$ and Ib denotes the integrated intensity of the peaks derived from the (104) plane of $Fe_3O_4$.

In the magnetic base body according to one embodiment of the present invention, an average particle size of the metal magnetic particles is no less than 1 μm and no more than 10 μm. The metal magnetic particles may be made of carbonyl iron.

In the magnetic base body relating to one embodiment of the present invention, an insulating film is formed on the surface of the metal magnetic particles.

One embodiment of the present invention relates to an electronic component. The electronic component includes the above-described magnetic base body.

The electronic component relating to one embodiment of the present invention includes the magnetic base body described above and a coil provided in the magnetic base body. The coil may be embedded in the magnetic base body. Alternatively, the coil may be provided in the magnetic base body such that at least a part of the coil is exposed to the outside of the magnetic base body.

A manufacturing method of a magnetic base body relating to one embodiment of the present invention includes steps of preparing metal magnetic particles with an Fe content of 98.5 wt % or more, mixing together the metal magnetic particles with a resin composition containing silsesquioxane or siloxane to produce a mixture, and thermally treating the mixture.

In one embodiment of the present invention, the preparing step includes a step of forming an insulating film on a surface of the metal magnetic particles.

In the thermally treating step, the mixture may be thermally treated in an atmosphere with an oxygen content of 50 ppm or more.

A manufacturing method of a magnetic base body relating to one embodiment of the present invention may include a step of subjecting the mixture to compression molding. The thermally treating step may include thermally treating the mixture that has been subjected to the compression molding.

Advantageous Effects

According to the embodiments disclosed herein, a highly insulating surface can be provided for a magnetic base body containing metal magnetic particles having a high Fe content.

DESCRIPTION OF THE EMBODIMENTS

Figure 1:
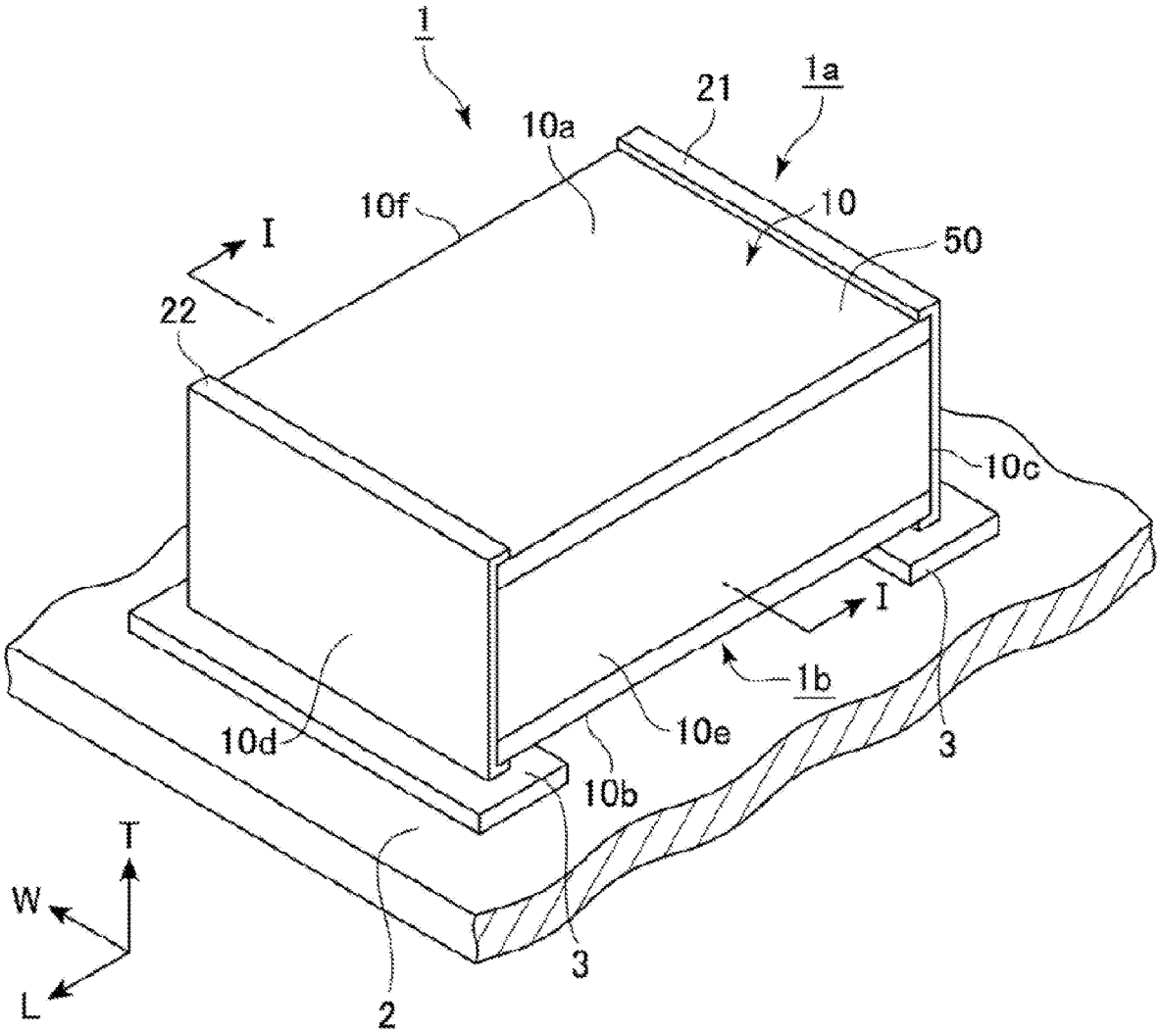
FIG. 1 is a perspective view showing a coil component relating to an embodiment of the invention.
Figure 2:
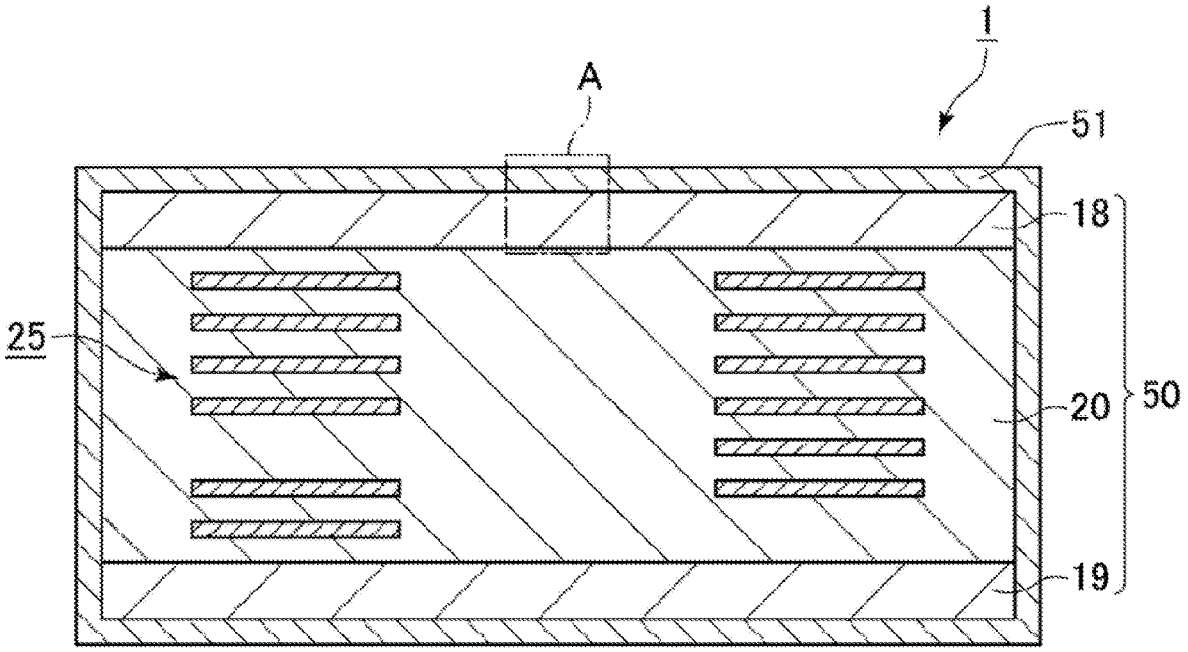
FIG. 2 is a view schematically showing a cross section of the coil component of FIG. 1 cut along the line I-I.
Figure 3:
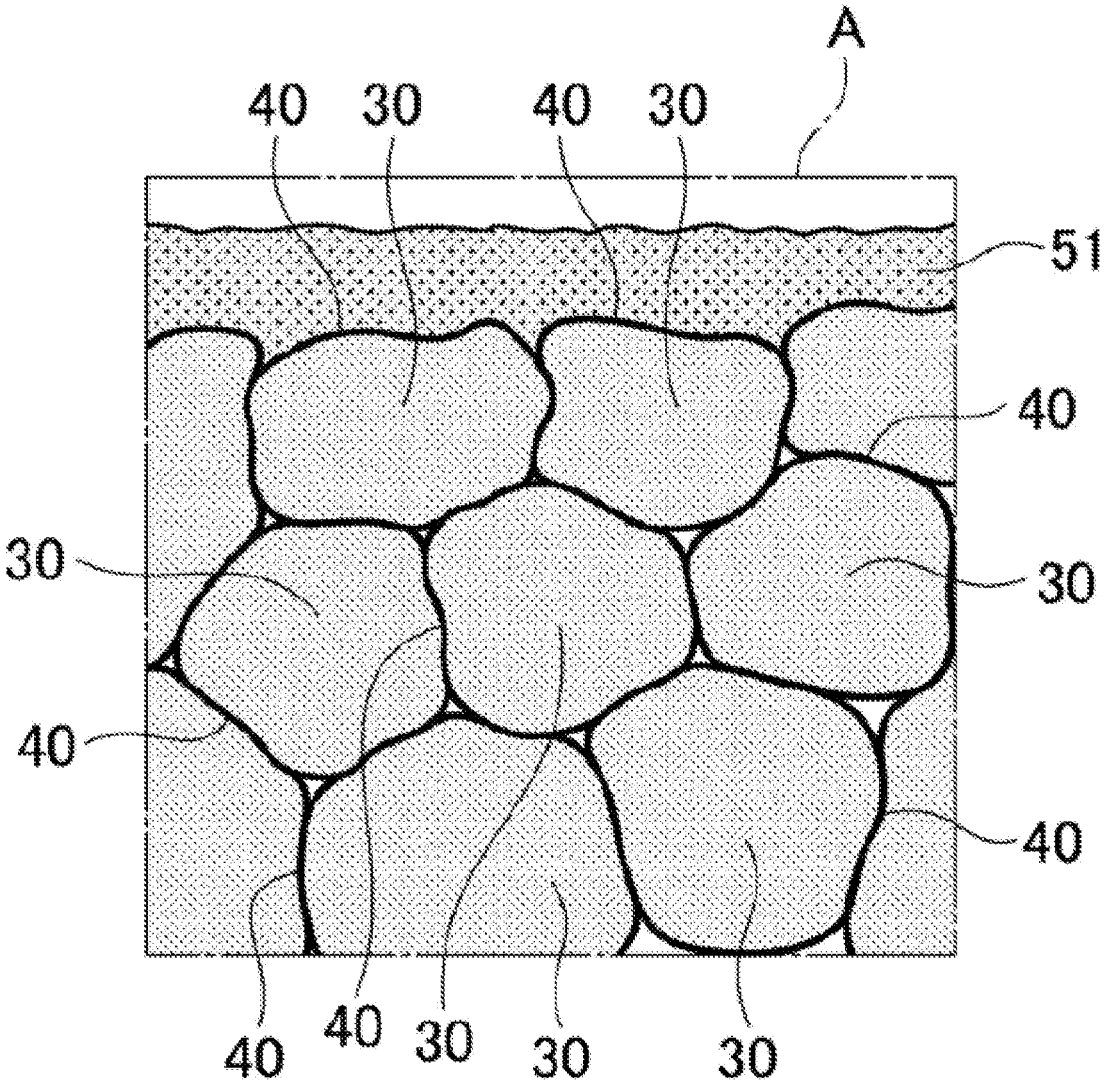
FIG. 3 is an enlarged schematic view of a region A of the magnetic base body shown in FIG. 2.
Figure 4:
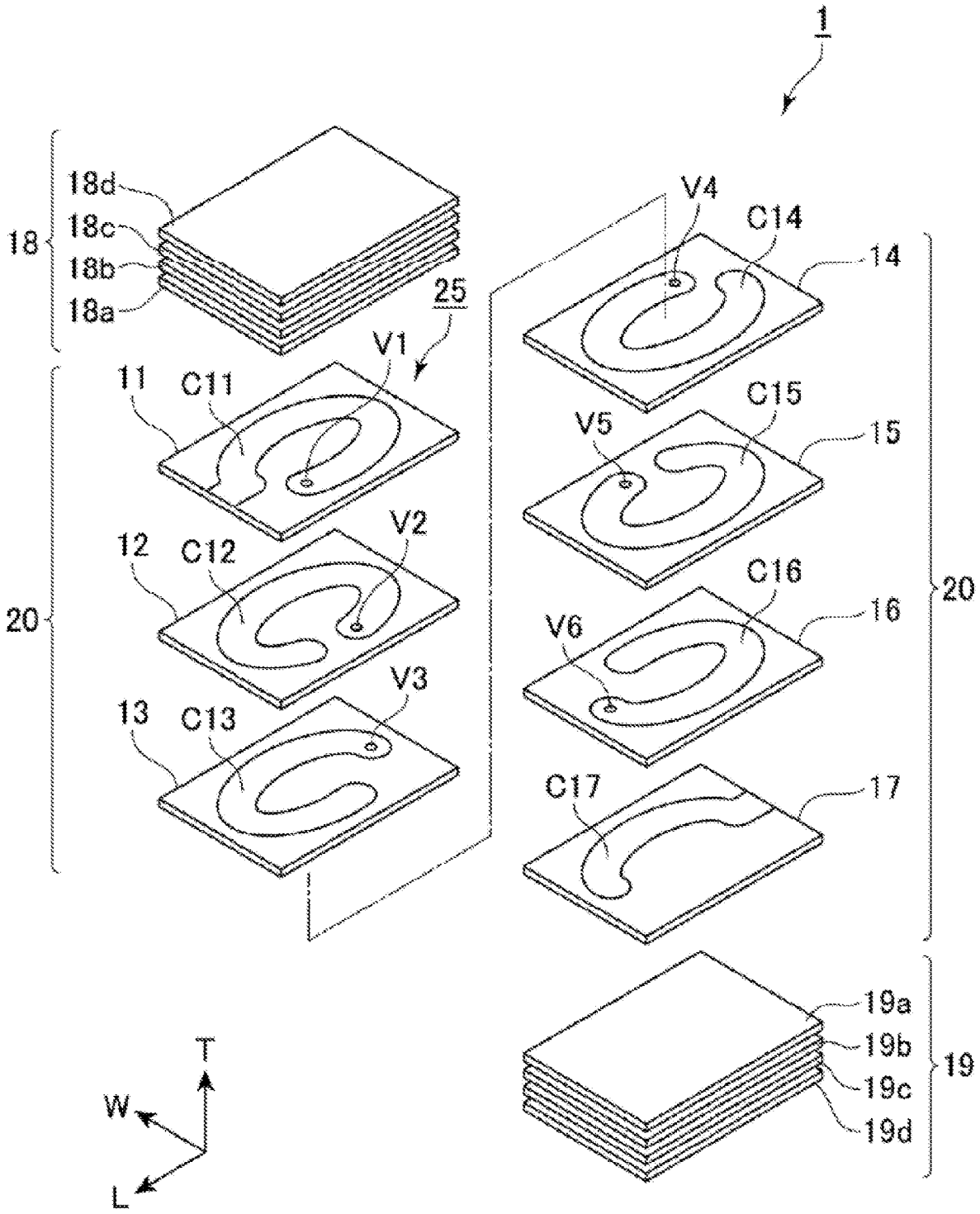
FIG. 4 is an exploded perspective view of the coil component shown in FIG. 1.

With reference to FIGS. 1 to 4, a magnetic base body relating to one embodiment of the present invention and an electronic component including the magnetic base body will be described. FIGS. 1 to 4 show an inductor 1 as an example of the electronic component relating to one embodiment of the present invention. More specifically, FIG. 1 is a perspective view showing an inductor 1 including a magnetic base body relating to one embodiment of the invention, FIG. 2 is a schematic sectional view of the inductor 1 of FIG. 1 cut along the line I-I, FIG. 3 is a schematic enlarged view of a region A of the magnetic base body shown in FIG. 2, and FIG. 4 is an exploded perspective view showing the inductor 1 of FIG. 1. In FIGS. 2 and 4, external electrodes are omitted for convenience of description.

The illustrated inductor 1 is one example of a coil component to which the present invention is applicable. The invention may be applied to, for example, transformers, filters, reactors, and various any other coil components in addition to inductors. The invention may be also applied to coupled inductors, choke coils, and any other magnetically coupled coil components. In this specification, a "length" direction, a "width" direction, and a "thickness" direction of the inductor 1 are referred to as an "L" axis direction, a "W" axis direction, and a "T" axis direction in FIG. 1, respectively, unless otherwise construed from the context.

As shown, the inductor 1 includes a magnetic base body 10, a coil conductor 25 provided in the magnetic base body 10, an external electrode 21 electrically connected to one of the ends of the coil conductor 25, and an external electrode 22 electrically connected to the other end of the coil conductor 25. In one embodiment of the invention, the magnetic base body 10 has a length (the dimension in the direction L) of 1.0 to 2.6 mm, a width (the dimension in the direction W) of 0.5 to 2.1 mm, and a thickness (the dimension in the direction T) of 0.5 to 1.0 mm. The dimension in the length direction may be 0.3 to 1.6 mm.

The inductor 1 is mounted on a circuit board 2. A land portion 3 may be provided on the circuit board 2. In the case where the inductor 1 includes the two external electrodes 21 and 22, the circuit board 2 is provided with the two land portions 3 correspondingly. The inductor 1 may be mounted on the circuit board 2 by bonding each of the external electrodes 21, 22 to the corresponding one of the land portions 3 on the circuit board 2. The circuit board 2 can be mounted in various electronic devices. Electronic devices in which the circuit board 2 may be mounted include smartphones, tablets, game consoles, and various other electronic devices. The inductor 1 may be a built-in component embedded in the circuit board 2.

The magnetic base body 10 has a first principal surface 10*a*, a second principal surface 10*b*, a first end surface 10*c*, a second end surface 10*d*, a first side surface 10*e*, and a second side surface 10*f*. The outer surface of the magnetic base body 10 may be defined by these six surfaces. The first principal surface 10*a* and the second principal surface 10*b* are opposed to each other, the first end surface 10*c* and the second end surface 10*d* are opposed to each other, and the first side surface 10*e* and the second side surface 10*f* are opposed to each other.

As shown in FIG. 1, the first principal surface 10*a* lies on the top side in the magnetic base body 10, and therefore, the first principal surface 10*a* may be herein referred to as "the top surface." Similarly, the second principal surface 10*b* may be referred to as "the bottom surface." The inductor 1 is disposed such that the second principal surface 10*b* faces the circuit board 2, and therefore, the second principal surface 10*b* may be herein referred to as "the mounting surface." The top-bottom direction of the inductor 1 refers to the top-bottom direction in FIG. 1.

The external electrode 21 is provided on the first end surface 10*c* of the magnetic base body 10. The external electrode 22 is provided on the second end surface 10*d* of the magnetic base body 10. As shown, these external electrodes may extend to the top and bottom surfaces of the magnetic base body 10. The shapes and positions of the external electrodes are not limited to the illustrated example. For example, both of the external electrodes 21, 22 may be provided on the bottom surface 10*b* of the magnetic base body 10. In this case, the coil conductor 25 is connected to the external electrodes 21, 22 on the bottom surface 10*b* of the magnetic base body 10 through via conductors. The external electrodes 21 and 22 may be separated from each other in the length direction. The distance between the external electrode 21 and the external electrode 22 is equal to or slightly smaller than the dimension in the length direction of the magnetic base body 10, or 0.3 to 1.6 mm.

The magnetic base body 10 includes a main body 50 formed of metal magnetic particles and an oxide film 51 formed on the surface of the main body 50. The main body 50 includes a magnetic layer 20 having a coil 25 embedded therein, an upper cover layer 18 formed on the upper surface of the magnetic layer 20 and made of a magnetic material, and a lower cover layer 19 formed on the lower surface of the magnetic layer 20 and made of a magnetic material. The boundary between the magnetic layer 20 and the upper cover layer 18 and the boundary between the magnetic layer 20 and the lower cover layer 19 may not be clearly identified depending on the manufacturing method used to fabricate the magnetic base body 10. The oxide film 51 is an insulating thin film formed on the surface of the main body 50 during the manufacturing process of the magnetic base body 10.

The main body 50 of the magnetic base body 10 is a structure formed of metal magnetic particles and generally has a rectangular parallelepiped shape. As shown in FIG. 3, the main body 50 contains a plurality of metal magnetic particles 30. Adjacent metal magnetic particles 30 are bonded to each other via an oxide phase 40. The metal magnetic particles 30 used as a magnetic material for the magnetic base body 10 may have an insulating film on the surface thereof. The insulating film is preferably formed to cover the whole surface of the metal magnetic particle. The insulating film formed on the surface of the metal magnetic particles can reduce short circuits between the metal magnetic particles, which can reduce eddy current loss. The insulating film is, for example, a silicon oxide film such as silica. The insulating film formed on the surface of the metal magnetic particles 30 has a thickness of, for example, no less than 5 nm and no more than 100 nm. The thicknesses of the insulating film formed on the metal magnetic particles 30 can depend on the average particle size of the metal magnetic metal particles 30.

The metal magnetic particles 30 are particles mainly composed of iron (Fe). The metal magnetic particles 30 are mainly composed of Fe. The Fe content in the metal magnetic particles 30 may be 98.5 wt % or larger. The metal magnetic particles 30 may be carbonyl iron particles with an Fe content of 99.9 wt % or more. In this specification, Fe contained in the metal magnetic particles can be identified using, for example, SEM/EDX (EDX: Scanning Electron Microscope/energy dispersive X-ray spectroscopy). As used herein, the Fe content in the metal magnetic particles 30 means the Fe content in the metal magnetic particles 30 contained in the magnetic base body 10 that has been subjected to thermal treatment.

In one embodiment, the average particle size of the metal magnetic particles is no less than 1 μm and no more than 10 μm. As the metal magnetic particles have an average particle size of 10 μm or less, the eddy current loss caused by the metal magnetic particles 30 can be reduced. The metal magnetic particles 30 can easily burn in the air when having a particle size of less than 1 μm. As the metal magnetic particles 30 have an average particle size of 1 μm or more, the metal magnetic particles 30 can be easily handled during the manufacturing process of the magnetic base body 10.

The metal magnetic particles 30 contained in the main body 50 are deformed due to the pressure applied in the compression molding step. The metal magnetic particles may have an approximately spherical shape before the pressure is applied in the compression molding step.

The metal magnetic particles 30 used to make the magnetic base body 10 may include two or more types of metal magnetic particles having different average particle sizes. For example, the metal magnetic particles 30 used to make the magnetic base body 10 may include first metal magnetic particles having a first average particle size and second metal magnetic particles having a second average particle size smaller than the first average particle size. In one embodiment, the average particle size of the second metal magnetic particles is ½ or less of the average particle size of the first metal magnetic particles. When the second metal magnetic particles have a smaller average particle size than the first metal magnetic particles, the second metal magnetic particles can easily enter the gap between the adjacent ones of the first metal magnetic particles. Consequently, the magnetic base body 10 can achieve a higher filling rate (density) of the metal magnetic particles 30. In one embodiment, the metal magnetic particles 30 used to make the magnetic base body 10 may further include third metal magnetic particles having a third average particle size smaller than the second average particle size.

The average particle size of the metal magnetic particles 30 contained in the magnetic base body 10 is determined based on a particle size distribution. To determine the particle size distribution, the magnetic base body 10 is cut along the thickness direction (T direction) to expose a section, and the section is scanned by a scanning electron microscope (SEM) to take a photograph at a 2000 to 5000-fold magnification, and the particle size distribution is determined based on the photograph. For example, the value at 50 percent of the particle size distribution determined based on the SEM photograph can be set as the average particle size of the metal magnetic particles.

The oxide phase 40 contains Si and iron oxide resulting from oxidization of the iron contained in the metal magnetic particles 30 during the manufacturing process of the magnetic base body 10. Si may exist in the form of an Si—O framework (Si—O structure). In one embodiment, the Si—O framework is derived from silsesquioxane or siloxane.

The oxide film 51 results from oxidization of the metal magnetic particles 30 contained in the main body 50. Accordingly, the oxide film 51 contains iron oxide. The oxide film 51 contains magnetite ($Fe_3O_4$) and hematite ($Fe_2O_3$). This means that the oxide film 51 is a magnetic film. Therefore, the oxide film 51 has a lower magnetic permeability than the main body 50 but still can contribute to the magnetic property of the magnetic base body 10. The oxide film 51 is integrated with the main body 50. The oxide film 51 is not affected by a change in temperature and thus can be used in high-temperature environment.

When the magnetic base body 10 is observed using an XRD diffraction pattern of the surface of the base body, which is obtained by means of X-ray diffraction (XRD) using a CuKα beam, a ratio Ia/Ib (hereinafter, may be referred to as "the HM peak intensity ratio") is 10 or more, where Ia denotes the integrated intensity of the peaks derived from the (220) plane of $Fe_2O_3$ (hematite) and Ib denotes the integrated intensity of the peaks derived from the (104) plane of $Fe_3O_4$ (magnetite). The XRD diffraction pattern of the magnetic base body 10 can be obtained by using an X-ray diffraction apparatus (for example, an X-ray diffraction apparatus (RINT-2500HK) available from Rigaku Corporation), utilizing a CuKα beam as the light source, applying voltage of 40 KV and scanning at a rate of 5°/min.

The HM peak intensity ratio may be calculated using the integrated intensity Ic of the peaks derived from the (110) plane of αFe in the XRD diffraction pattern of the magnetic base body 10. Specifically speaking, the HM peak intensity ratio may be calculated as the ratio of Ia/Ic to Ib/Ic. αFe is contained in the main body 50 but not in the oxide film 51. Therefore, if the oxide film 51 has a large thickness, the peaks derived from the (110) plane of αFe are no longer detected in the XRD diffraction pattern of the magnetic base body 10. For this reason, if the oxide film 51 is so thick that the peaks derived from the (110) plane of αFe are no longer detected, the ratios Ia/Ic and Ib/Ic reach an infinite value. As a result, the HM peak intensity ratio cannot be calculated. In one embodiment, the oxide film 51 has a thickness of 10 μm or less. If the thickness of the oxide film 51 is 10 μm or less, the peaks derived from the (110) plane of αFe contained in the main body 50 can be detected. The thickness of the oxide film 51 can be defined as follows. The magnetic base body 10 is cut along the thickness direction (T direction) to expose the cross-section, and the cross-section is photographed by a scanning electron microscope (SEM) with a magnification ratio of 2000 to 5000. Based on the photograph, the distance from the external surface of the magnetic base body 10 to the boundary between the main body 50 and the oxide film 51 is calculated and treated as the thickness of the oxide film 51. As schematically shown in FIG. 3, while the granular metal magnetic particles 30 can be visually observed in the main body 50, few or no particle boundaries can be visually observed in the oxide film 51. Accordingly, the boundary between the main body 50 and the oxide film 51 can be clearly distinguished in the SEM image. Since the main body 50 has an uneven surface (the boundary surface between the oxide film 51 and the main body 50), the distance from the external surface of the magnetic base body 10 to the boundary between the main body 50 and the oxide film 51 varies among the positions where the distance is measured. Therefore, the distance from the external surface of the magnetic base body 10 to the boundary between the main body 50 and the oxide film 51 may be measured at more than one measurement position, the measured lengths at these positions may be averaged and the result may be treated as the thickness of the oxide film 51. When the XRD diffraction pattern of the surface of the magnetic base body 10 is obtained using XRD, a coating layer or film other than the oxide film 51 may be discovered near the surface of the magnetic base body 10 outside the oxide film 51. If such is the case, appropriate processing such as polishing and ion milling is performed to treat the surface of the magnetic base body 10 to expose the oxide film 51. X-ray diffraction analysis is then performed on the magnetic base body 10 having the oxide film 51 exposed.

Next, the lamination structure of the inductor 1 will be described with reference to FIG. 4. FIG. 4 is an exploded perspective view showing the inductor 1, which is fabricated by the laminating process. As shown in FIG. 4, the magnetic layer 20 includes magnetic films 11 to 17. In the magnetic layer 20, the magnetic films 11, 12, 13, 14, 15, 16 and 17 are stacked in the stated order from the positive side to the negative side in the T direction. The inductor 1 may be fabricated using a technique other than the laminating process. For example, the inductor 1 may be alternatively fabricated by the thin film process. The inductor 1 may be a winding coil in which winding wires are wound around a core.

On the respective upper surfaces of the magnetic films 11 to 17, conductor patterns C11 to C17 are formed. The conductor patterns C11 to C17 are formed by, for example, printing a conductive paste made of a highly conductive metal or alloy via screen printing. The conductive paste may be made of Ag, Pd, Cu, Al, or alloys thereof. The conductor patterns C11 to C17 may be formed using other methods and materials. For example, the conductor patterns C11 to C17 may be formed by sputtering, ink-jetting, or other known methods.

The magnetic films 11 to 16 are provided with vias V1 to V6, respectively, at a predetermined position therein. The vias V1 to V6 are formed by forming a through-hole at the predetermined position in the magnetic films 11 to 16 so as to extend through the magnetic films 11 to 16 in the T axis direction and filling the through-holes with a conductive material.

Each of the conductor patterns C11 to C17 is electrically connected to adjacent conductor patterns through the vias V1 to V6. The conductor patterns C11 to C17 connected in this manner form the spiral coil conductor 25. In other words, the coil conductor 25 is constituted by the conductor patterns C11 to C17 and the vias V1 to V6.

The end of the conductor pattern C11 opposite to the end thereof connected to the via V1 is connected to the external electrode 22. The end of the conductor pattern C17 opposite to the end thereof connected to the via V6 is connected to the external electrode 21.

The upper cover layer 18 includes magnetic films 18*a* to 18*d* made of a magnetic material, and the lower cover layer 19 includes magnetic films 19*a* to 19*d* made of a magnetic material. In this specification of the present invention, the magnetic films 18*a* to 18*d* and the magnetic films 19*a* to 19*d* may be referred to collectively as "the cover layer magnetic films."

The following describes an example method of fabricating the inductor 1. The inductor 1 can be produced by, for example, the laminating process. The following describes, as an example, the method of fabricating the inductor 1 using the laminating process.

To begin with, magnetic sheets are fabricated to form the respective magnetic films constituting the magnetic base body 10 (the magnetic films 18*a* to 18*d* making up the upper cover layer 18, the magnetic films 11 to 17 making up the magnetic layer 20, and the magnetic films 19*a* to 19*d* making up the lower cover layer 19). In order to fabricate the magnetic sheets, the metal magnetic particles 30 are first prepared. In the step of preparing the metal magnetic particles 30, an insulating film may be formed on the surface of the metal magnetic particles 30. In one embodiment, the insulating film provided on the surface of the metal magnetic particles 30 is a silicon oxide film. The silicon oxide film is, for example, formed on the surface of each metal magnetic particle through a coating process using the sol-gel method. More specifically, a process solution containing TEOS (tetraethoxysilane, $Si(OC_2H_5)_4$), ethanol, and water is mixed into a mixed solution containing metal magnetic particles, ethanol, and aqueous ammonia to prepare a mixture. Then, the mixture is stirred and then filtered to separate the metal magnetic particles 30 that have a silicon oxide film formed on their surface. The metal magnetic particles 30 having the silicon oxide film formed thereon may be subjected to thermal treatment. The thermal treatment is performed at a temperature of 400 to 800° C. for a duration of 20 to 60 minutes in a reducing atmosphere, for example.

Subsequently, a group of metal magnetic particles 30, a resin composition and a solvent are mixed together to make a slurry (mixture). The resin composition contains a binder resin and a Si compound. The Si compound is dissolved in the binder resin. The Si compound dissolved in the binder resin is, for example, silsesquioxane, siloxane, any other Si compound containing an Si—O framework (Si—O structure), or a mixture thereof. Silsesquioxane has an $R—SiO_{1.5}$ structure. Here, R is an organic functional group. Siloxane has an —Si—O—Si— structure. The Si compound dissolved in the binder resin is not in a solid phase such as a filler in the binder resin, but in a semi-solid or liquid phase including a sol-gel state. A commonly used mesh can not separate the Si compound dissolved in the binder resin from the binder resin. The silsesquioxane used as the Si compound may be methylsilsesquioxane, phenylsilsesquioxane, or a mixture of these. The siloxane used as the Si compound may be hydroxymethylsiloxane, hydroxyphenylsiloxane, dimethylsiloxane or a mixture of these. Any solvent can be used as long as it can dissolve the above-listed Si compounds therein. For example, toluene is used as the solvent. As the binder resin in the resin composition, any binder resin can be used as long as it can dissolve in the solvent. The binder resin can be a highly insulating thermosetting resin. More specifically, the binder resin can be an epoxy resin, a phenolic resin, a polyimide resin, a silicone resin, polystyrene (PS) resin, a high density polyethylene (HDPE) resin, a polyoxymethylene (POM) resin, a polycarbonate (PC) resin, a polyvinylidene fluoride (PVDF) resin, a phenolic resin, a polytetrafluoroethylene (PTFE) resin, a polybenzoxazole (PBO) resin, a polyvinyl alcohol (PVA) resin, a polyvinyl butyral (PVB) resin, an acrylic resin or a mixture of these. The binder resin and Si compound dissolved in the solvent may be separate from each other in the solvent, but, in many cases, physically and/or chemically bonded to each other.

Subsequently, the above-described slurry is applied to the surface of a plastic base film using the doctor blade technique or any other common methods and then dried, and the dried slurry is cut to a predetermined size. In this way, sheet members are formed.

After this, a coil conductor is provided in the sheets of the magnetic material fabricated in the above manner. Specifically, a through-hole is formed in the respective sheets of the magnetic material, which are to be used as the magnetic films 11 to 16, at a predetermined position so as to extend through the sheets in the direction of the axis T. Following this, a conductive paste is printed by screen printing on the upper surface of each of the sheets of the magnetic material, which are to be used as the magnetic films 11 to 17, so that a conductor pattern is formed on each sheet of the magnetic material. Also, the through-hole formed in each sheet of the magnetic material is filled with a conductive paste. In the above manner, the conductor patterns formed on the sheets of the magnetic material, which are to be used as the magnetic films 11 to 17, respectively form the conductor patterns C11 to C17, and the metal filling the through-holes forms the vias V1 to V6. The conductor patterns can be formed using various known techniques other than screen printing.

Next, the sheets of the magnetic material, which are to be used as the magnetic films 11 to 17, are stacked to obtain a coil laminated body. The sheets of the magnetic material, which are to be used as the magnetic films 11 to 17, are stacked such that the conductor patterns C11 to C17 formed on the respective sheets of the magnetic material are each electrically connected to the adjacent conductor patterns through the vias V1 to V6.

Following this, a plurality of sheets of a magnetic material are stacked to form an upper laminated body, which is to be used as the upper cover layer 18. Similarly, a plurality of sheets of a magnetic material are stacked to form a lower laminated body, which is to be used as the lower cover layer 19.

Next, the lower laminated body, the coil laminated body, and the upper laminated body are stacked in the stated order from the negative side to the positive side in the direction of the axis T, and these stacked laminates are bonded together by thermal compression using a pressing machine to produce a main laminated body. Instead of forming the lower, coil and upper laminated bodies, the main laminated body may be formed by sequentially stacking all of the sheets of the magnetic material prepared in advance and bonding the stacked sheets of the magnetic material collectively by thermal compression. Next, the main laminated body is diced in a desired size using a cutter such as a dicing machine or a laser processing machine to obtain individual chip laminated bodies. Polishing treatment such as barrel polishing may be performed on the end portions of the chip laminated body, if necessary.

Next, the chip laminated body is degreased and then subjected to thermal treatment, so that the magnetic base body 10 is obtained. The thermal treatment forms the oxide phase 40 on the surface of the metal magnetic particles, so that the adjacent metal magnetic particles 30 are bonded to each other via the oxide phase 40 sandwiched therebetween. During the thermal treatment, the oxide film 51 is also formed on the surface of the magnetic base body 10. The thermal treatment on the chip laminated body is performed within an oxygen atmosphere containing oxygen of, for example, 50 ppm to 1000 ppm at a temperature of 500° C. or more, preferably, 600° C. to 900° C., for a duration of 20 minutes to 120 minutes. As the oxygen concentration increases, the thickness of the oxide film 51 increases, which resultantly lowers the magnetic permeability of the magnetic base body 10. The upper limit of the oxygen concentration is determined such that the thickness of the oxide film 51 is 10 μm or less. As the oxygen concentration decreases, the formation of the oxide film 51 becomes increasingly difficult and the continuity of the oxide film 51 may be compromised on the surface of the main body 50. As a consequence, there is a risk that the magnetic base body 10 may not have reliable insulating property. The lower limit of the oxygen concentration is, preferably, no less than 80 ppm, more preferably no less than 100 ppm. The upper limit of the oxygen concentration is, preferably, no less than 200 ppm, more preferably no less than 150 ppm. The metal magnetic particles 30 can be prevented from being oxidized excessively by using as the Si compound silsesquioxane, methylsilsesquioxane, phenylsilsesquioxane, or a mixture of these. This allows the oxide film 51 to be formed on the surface of the magnetic base body 10 without increasing the thickness of the oxide phase 40.

Next, a conductive paste is applied to both end portions of the chip laminate to form the external electrodes 21 and 22. At least one of a solder barrier layer and a solder wetting layer may be formed on the external electrode 21 and the external electrode 22 as necessary. In the above-described manner, the inductor 1 is obtained. In the above-described process of manufacturing the inductor 1, the magnetic base body 10 relating to one embodiment of the present invention is fabricated. The manufacturing process of the magnetic base body 10 includes a step of preparing the metal magnetic particles 30, a step of mixing the metal magnetic particles 30 with a resin composition containing silsesquioxane or siloxane to produce a mixture (slurry), and a step of thermally treating the slurry. According to the above description, the manufacturing process of the inductor 1 involves the laminating process, and the coil conductor is formed before the molded body made of the slurry is thermally treated. In other manufacturing processes, however, the coil conductor may be provided after the thermal treatment. For example, when a winding coil is manufactured, the slurry is thermally treated to manufacture the magnetic base body and winding wires are then wound around the magnetic base body.

Some of the steps included in the above manufacturing method can be skipped as appropriate. In the manufacturing method of the inductor 1, steps not described explicitly in this specification may be performed as necessary. Some of the steps included in the manufacturing method of the inductor 1 may be performed in different orders within the purposes of the present invention. Some of the steps included in the manufacturing method of the inductor 1 may be performed at the same time or in parallel, if possible.

Figure 5:
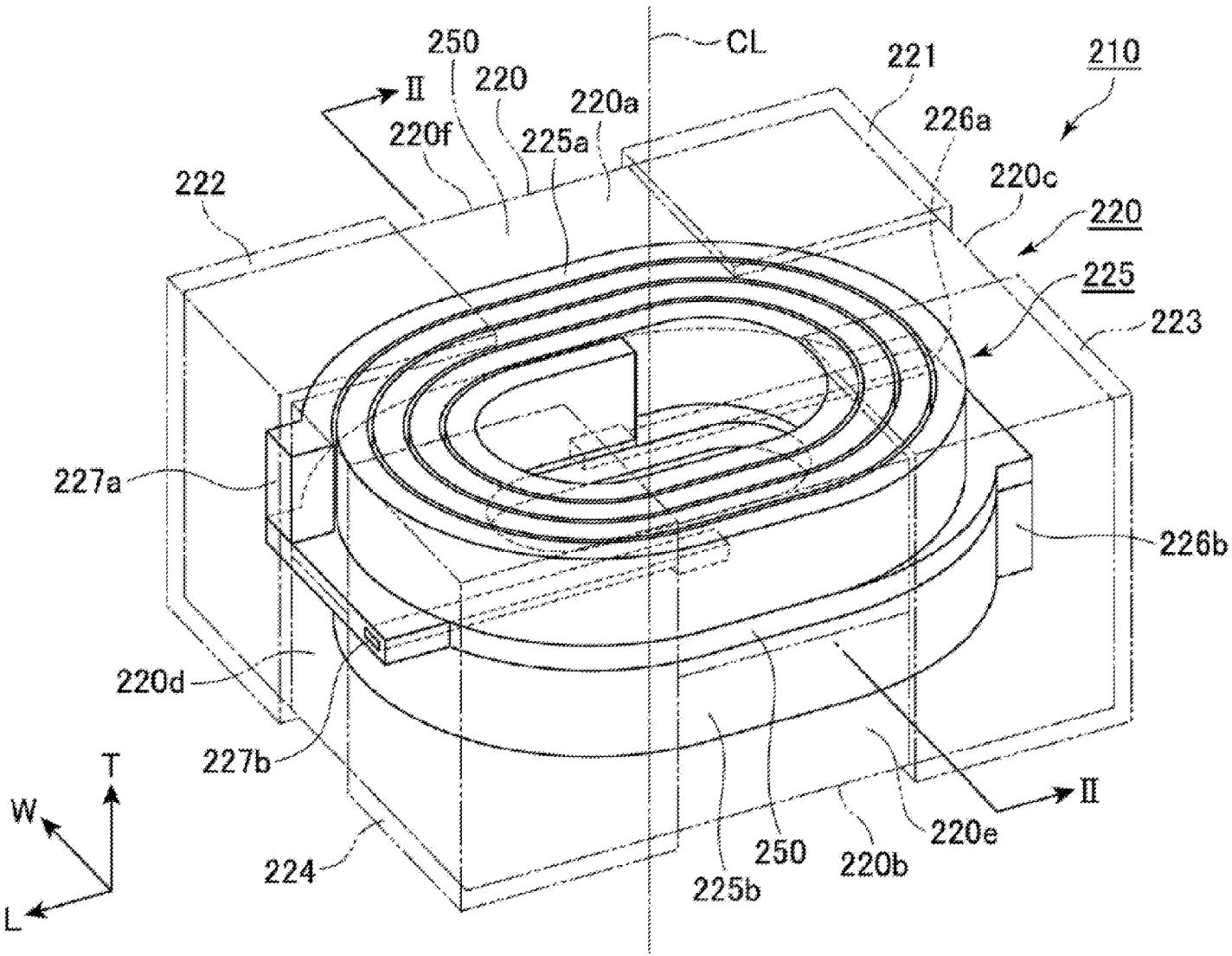
FIG. 5 is a perspective view of a coil component relating to another embodiment of the invention.
Figure 6:
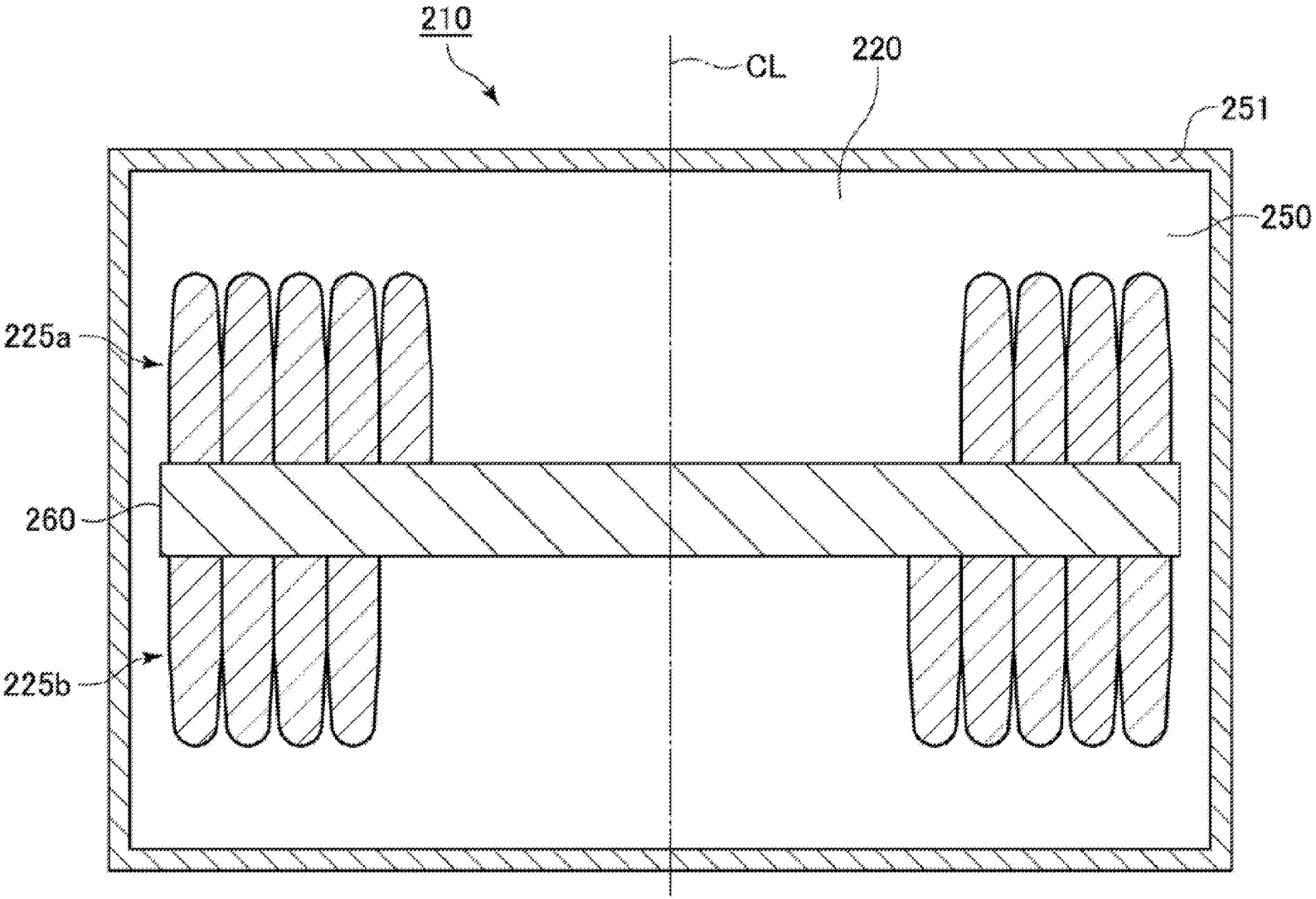
FIG. 6 schematically shows a cross section of the coil component of FIG. 5 cut along the line II-II.

Next, a coil component relating to another embodiment of the present invention will be described with reference to FIGS. 5 and 6. As shown in FIGS. 5 and 6, a coil component 210 relating to one embodiment of the present invention includes a magnetic base body 220, a coil conductor 225 provided in the magnetic base body 220, an insulating plate 260 provided in the magnetic base body 220, and four external electrodes 221 to 224.

In one embodiment of the present invention, the magnetic base body 220 includes a main body 250 and an oxide film 251 formed on the surface of the main body 250. The main body 250 is a structure formed of the metal magnetic particles 30, like the main body 50. The oxide film 251 results from oxidization of the metal magnetic particles 30 contained in the main body 250. The oxide film 251 contains magnetite ($Fe_3O_4$) and hematite ($Fe_2O_3$). When the magnetic base body 220 is observed using an XRD diffraction pattern, which is obtained by means of X-ray diffraction (XRD) using a CuKα beam, a ratio Ia/Ib is 10 or more where Ia denotes the integrated intensity of the peaks derived from the (220) plane of $Fe_2O_3$ (hematite) and Ib denotes the integrated intensity of the peaks derived from the (104) plane of $Fe_3O_4$ (magnetite). Since the ratio of $Fe_2O_3$ (hematite) to $Fe_3O_4$ (magnetite) is high in the oxide film 251 formed on the surface of the main body 250 of the magnetic base body 220, the magnetic base body 220 can have a highly insulating surface.

The magnetic base body 220 is generally shaped as a rectangular parallelepiped and has a first principal surface 220*a*, a second principal surface 220*b*, a first end surface 220*c*, a second end surface 220*d*, a first side surface 220*e*, and a second side surface 220*f*. The outer surface of the magnetic base body 220 is defined by these six surfaces.

The insulating plate 260 is made of an insulating material and has a plate-like shape. The insulating material used for the insulating plate 260 may be magnetic. The magnetic material used for the insulating plate 260 is, for example, a composite magnetic material containing a binder and magnetic particles. In one embodiment of the invention, the insulating plate 260 has a larger resistance than the magnetic base body 220. Thus, even when the insulating plate 260 has a small thickness, electric insulation between a coil conductor 225*a* and a coil conductor 225*b* can be ensured.

In the embodiment shown, the coil conductor 225 includes the coil conductor 225*a* formed on the top surface of the insulating plate 260 and the coil conductor 225*b* formed on the bottom surface of the insulating plate 260. The coil conductor 225*a* is formed in a predetermined pattern on the top surface of the insulating plate 260, and the coil conductor 225*b* is formed in a predetermined pattern on the bottom surface of the insulating plate 260. An insulating film may be provided on the surface of the coil conductors 225*a* and 225*b*. In the coil component 210 shown, the coil conductor 225*a* and the coil conductor 225*b* are magnetically coupled. The coil component 210 can be formed without the coil conductor 225*b*. In this case, the coil component 210 includes the coil conductor 225*a* formed on the top surface of the insulating plate 260 but has no coil conductors formed on the bottom surface of the insulating plate 260. The coil conductor 225 can be provided in various shapes. When seen from above, the coil conductor 225 has, for example, a spiral shape, a meander shape, a linear shape or a combined shape of these.

The coil conductor 225*a* has a lead-out conductor 226*a* on one end thereof and a lead-out conductor 227*a* on the other end. The lead-out conductor 226*a* is used to establish electrical connection with the external electrode 221, and the lead-out conductor 227*a* is used to establish electrical connection with the external electrode 222. Likewise, the coil conductor 225*b* has a lead-out conductor 226*b* on one end thereof and a lead-out conductor 227*b* on the other end. An internal conductor 228*b* of the coil conductor 225*b* is electrically connected to the external electrode 223 via the lead-out conductor 226*b* and is electrically connected to the external electrode 224 via the lead-out conductor 227*b*.

In the embodiment shown, the external electrode 221 is electrically connected to one end of the coil conductor 225*a*, and the external electrode 222 is electrically connected to the other end of the coil conductor 225*a*. The external electrode 223 is electrically connected to one end of the coil conductor 225*b*, and the external electrode 224 is electrically connected to the other end of the coil conductor 225*b*. The external electrode 221 and the external electrode 223 are provided on the first end surface 220*c* of the magnetic base body 220. The external electrode 222 and the external electrode 224 are provided on the second end surface 220*d* of the magnetic base body 220. As shown, these external electrodes may extend to the top and bottom surfaces 220*a* and 220*c* of the magnetic base body 220. The shapes and positions of the external electrodes 221 to 224 may be changed as appropriate.

Next, a description is given of an example of a manufacturing method of the coil component 210. To start with, an insulating plate made of a magnetic material and shaped like a plate is prepared. Next, a photoresist is applied to the top surface and the bottom surface of the insulating plate, and then conductor patterns are transferred onto the top surface and the bottom surface of the insulating plate by exposure, and development is performed. As a result, a resist having an opening pattern for forming a coil conductor is formed on each of the top surface and the bottom surface of the insulating plate. For example, the conductor pattern formed on the top surface of the insulating plate corresponds to the coil conductor 225*a* described above, and the conductor pattern formed on the bottom surface of the insulating plate corresponds to the coil conductor 225*b* described above. The coil conductor 225*a* and the coil conductor 225*b* may be fabricated by electrically connecting together, for example, through a via conductor, two or more coil patterns formed in two or more layers.

Next, plating is performed, so that each of the opening patterns is filled with a conductive metal. Next, etching is performed to remove the resists from the insulating plate, so that the coil conductors are formed on the top surface and the bottom surface of the insulating plate.

A magnetic base body is subsequently formed on both surfaces of the insulating plate having the coil conductors formed thereon. This magnetic base body corresponds to the magnetic base body 220 described above. To form the magnetic base body, a sheet of a magnetic material is first fabricated. To fabricate the sheet of a magnetic material, the metal magnetic particles 30 are prepared and mixed with a resin composition to make a slurry (mixture). The resin composition contains a binder resin and a Si compound. The Si compound contained in the resin composition is, for example, silsesquioxane, siloxane, or any other compound containing an Si—O framework (Si—O structure). The slurry is then applied to a surface of a plastic base film using the doctor blade technique or any other common methods and dried, and the dried slurry is cut to a predetermined size, so that the sheet of the magnetic material is obtained. A plurality of sheets of the magnetic material are fabricated. The above-described coil conductors are placed between the sheets of the magnetic material fabricated in the above-described manner, and pressure is applied while heating is performed. In this way, a laminated body is fabricated. The laminated body is then thermally treated in a thermal treatment step. The laminated body is thermally treated within an oxygen atmosphere containing oxygen of, for example, 50 ppm to 1000 ppm at a temperature of 500° C. or more, preferably, 600° C. to 900° C., for a duration of 20 minutes to 120 minutes. In this way, the magnetic base body having the coil conductors therein can be obtained. External electrodes are provided on the external surface of the magnetic base body at predetermined positions. In this manner, the coil component 210 is completed. The lower limit of the oxygen concentration is preferably no less than 80 ppm, more preferably no less than 100 ppm. The upper limit of the oxygen concentration is preferably no more than 200 ppm, more preferably no more than 150 ppm. The magnetic base body may be fabricated using a technique other than the above method. For example, the above-described coil conductors and slurry are prepared, and the slurry is applied to the coil conductors to obtain a non-thermally-treated base body. The non-thermally-treated base body is thermally treated to complete the magnetic base body. The preceding description of the resin composition used to make the magnetic base body 10 similarly applies to the resin composition used to make the magnetic base body 220.

Figure 7:
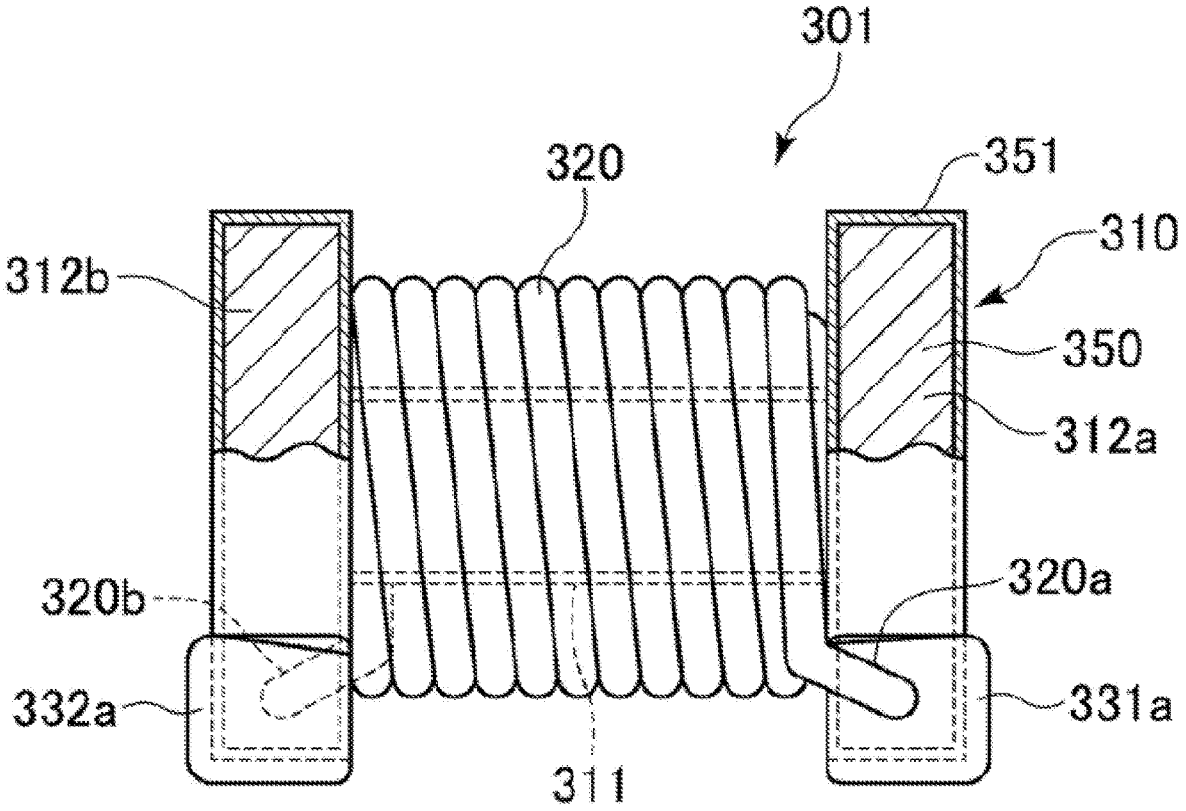
FIG. 7 schematically shows a coil component relating to another embodiment of the present invention.

The following describes a coil component 301 relating to another embodiment of the present invention with reference to FIG. 7. The coil component 301 relating to one embodiment of the present invention is a winding inductor. As shown, the coil component 301 includes a drum core 310, a winding wire 320, a first external electrode 331*a* and a second external electrode 332*a*. The drum core 310 includes a winding core 311, a flange 312*a* having a rectangular parallelepiped shape and provided on one end of the winding core 311, and a flange 312*b* having a rectangular parallelepiped shape and provided on the other end of the winding core 311. The winding wire 320 is wound on the winding core 311. The winding wire 320 is formed by applying an insulation coating around a conductor wire made of a metal material having excellent electrical conductivity. The first external electrode 331*a* extends along the bottom surface of the flange 312*a*, and the second external electrode 332*a* extends along the bottom surface of the flange 312*b*.

The drum core 310 includes a main body 350 and an oxide film 351 formed on the surface of the main body 350. The main body 350 is a structure formed of the metal magnetic particles 30, like the main body 50. The oxide film 351 results from oxidization of the metal magnetic particles 30 contained in the main body 350. The oxide film 351 contains magnetite ($Fe_3O_4$) and hematite ($Fe_2O_3$). When the drum core 310 is observed using an XRD diffraction pattern, which is obtained by means of X-ray diffraction (XRD) using a CuKα beam, a ratio Ia/Ib is 10 or more where Ia denotes the integrated intensity of the peaks derived from the (220) plane of $Fe_2O_3$ (hematite) and Ib denotes the integrated intensity of the peaks derived from the (104) plane of $Fe_3O_4$ (magnetite). Since the ratio of $Fe_2O_3$ (hematite) to the $Fe_3O_4$ (magnetite) is high in the oxide film 351 formed on the surface of the main body 350 of the drum core 310, the drum core 310 can have a highly insulating surface.

The following describes the method of fabricating the drum core 310. To begin with, the metal magnetic particles 30 are prepared. Subsequently, a group of metal magnetic particles 30 and a resin composition are mixed together to make a slurry (mixture). The resin composition contains a binder resin and a Si compound. The Si compound is dissolved in the binder resin. The Si compound contained in the resin composition is, for example, silsesquioxane, siloxane, or any other compound containing an Si—O framework (Si—O structure). The slurry is poured into the cavity of a mold to fill the cavity and pressed, so that a molded body is fabricated. The molded body is sintered to manufacture the drum core 310. The coil component 301 is produced by winding the winding wire 320 around the drum core 310, connecting one end of the winding wire 320 to the first external electrode 331*a*, and connecting the other end to the second external electrode 332*a*. The preceding description of the resin composition used to make the magnetic base body 10 similarly applies to the resin composition used to make the drum core 310.

Figure 8:
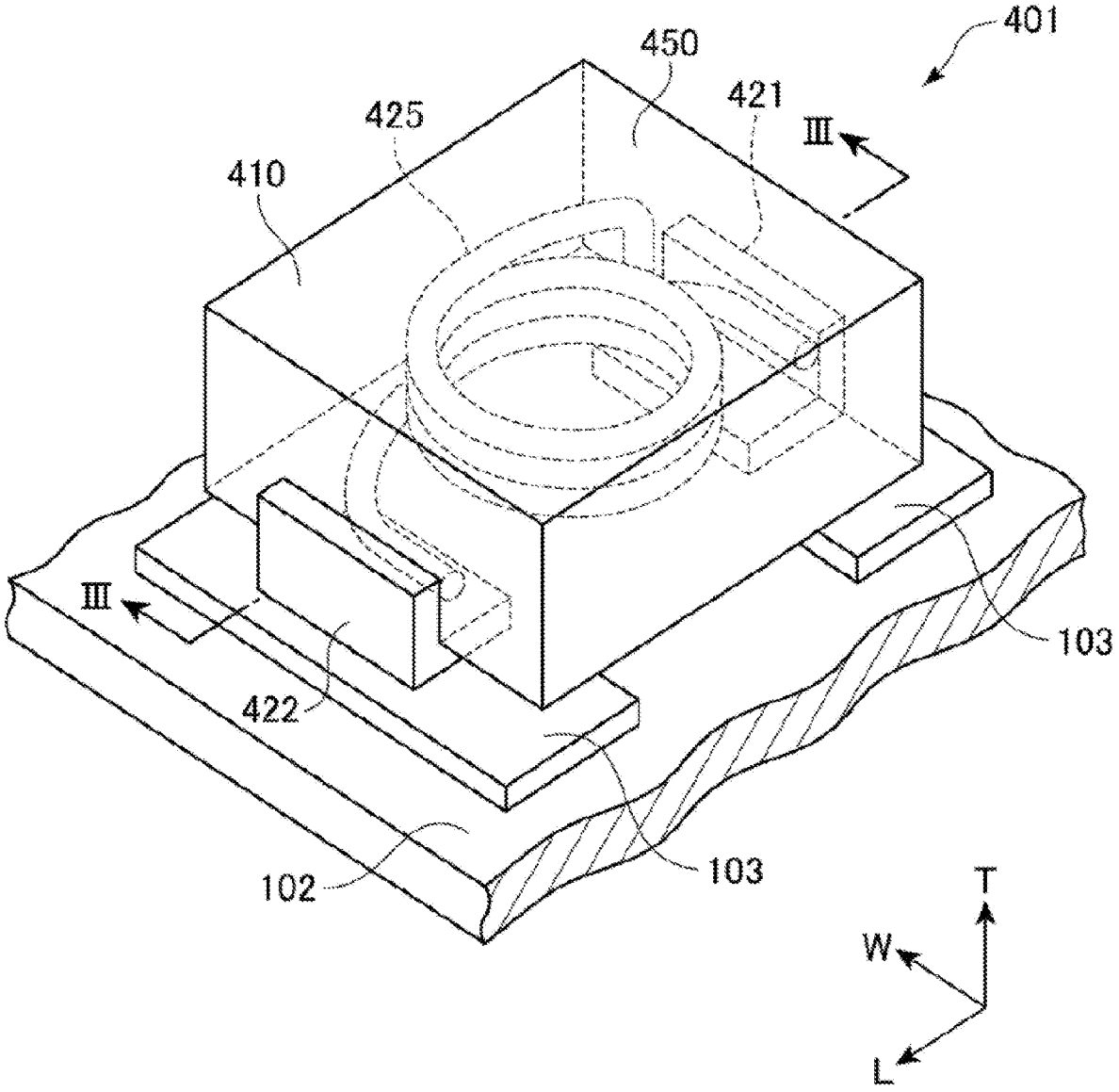
FIG. 8 is a perspective view of a coil component relating to another embodiment of the invention.
Figure 9:
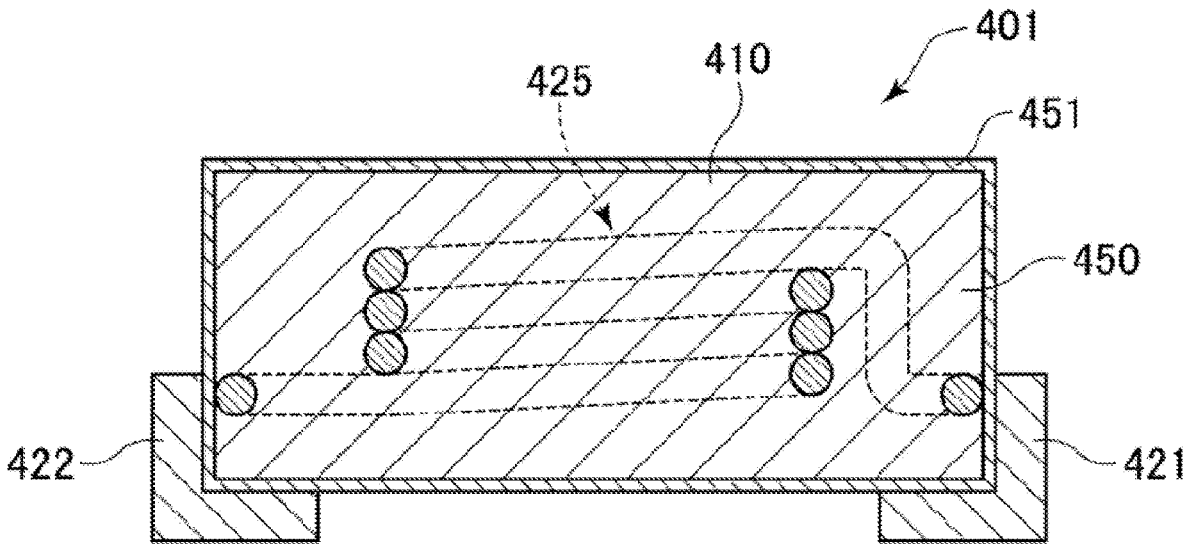
FIG. 9 schematically shows a cross section of the coil component of FIG. 8 cut along the line III-III.

Next, a coil component 401 relating to another embodiment of the present invention will be described with reference to FIGS. 8 and 9. As shown in FIGS. 8 and 9, the inductor 401 includes a magnetic base body 410, a coil conductor 425 provided in the magnetic base body 410, an external electrode 421 electrically connected to one end of the coil conductor 425, and an external electrode 422 electrically connected to the other end of the coil conductor 425.

The magnetic base body 410 includes a main body 450 and an oxide film 451 formed on the surface of the main body 450. The main body 450 is a structure formed of the metal magnetic particles 30, like the main body 50. The oxide film 451 results from oxidization of the metal magnetic particles 30 contained in the main body 450. The oxide film 451 contains magnetite ($Fe_3O_4$) and hematite ($Fe_2O_3$). When the magnetic base body 410 is observed using an XRD diffraction pattern, which is obtained by means of X-ray diffraction (XRD) using a CuKα beam, a ratio Ia/Ib is 10 or more where Ia denotes the integrated intensity of the peaks derived from the (220) plane of $Fe_2O_3$ (hematite) and Ib denotes the integrated intensity of the peaks derived from the (104) plane of $Fe_3O_4$ (magnetite). Since the ratio of $Fe_2O_3$ (hematite) to $Fe_3O_4$ (magnetite) is high in the oxide film 451 formed on the surface of the main body 450 of the magnetic base body 410, the magnetic base body 410 can have a highly insulating surface.

Next, the manufacturing method of the coil component 401 will be described. To begin with, the metal magnetic particles 30 are prepared. Subsequently, the metal magnetic particles 30 and a resin composition are mixed together to make a slurry (mixture). The resin composition contains a binder resin and a Si compound. The Si compound is dissolved in the binder resin. The Si compound contained in the resin composition is, for example, silsesquioxane, siloxane, or any other compound containing an Si—O framework (Si—O structure). Next, a coil conductor, which is prepared in advance, is placed in a mold, the slurry is then poured into the mold in which the coil conductor is placed, and a compacting pressure is applied thereto to obtain a molded body containing the coil conductor thereinside. The molded body is then thermally treated. The molded body is thermally treated within an oxygen atmosphere containing oxygen of, for example, 50 ppm to 1000 ppm at a temperature of 500° C. or more, preferably, 600° C. to 900° C., for a duration of 20 minutes to 120 minutes. In this way, the magnetic base body 410 having the coil conductor 425 therein can be obtained. Next, a conductor paste is applied to both end portions of the magnetic base body 410, which is produced in the above-described manner, to form the external electrode 421 and the external electrode 422. The external electrode 421 and the external electrode 422 are provided such that they are electrically coupled to respective ends of the coil conductor 425 provided in the magnetic base body 410. The external electrodes 421, 422 may include a plating layer. There may be two or more plating layers. The two plating layers may include an Ni plating layer and an Sn plating layer externally provided on the Ni plating layer. Thus, the coil component 401 is obtained. The lower limit of the oxygen concentration is preferably no less than 80 ppm, more preferably no less than 100 ppm. The upper limit of the oxygen concentration is preferably no more than 200 ppm, more preferably no more than 150 ppm. The preceding description of the resin composition used to make the magnetic base body 10 similarly applies to the resin composition used to make the magnetic base body 410.

Working Examples

The following describes working examples of the present invention. To start with, metal magnetic particles having an average particle size of 5 μm were prepared, and a silica film having a thickness of 20 nm was formed using the sol-gel method on the surface of the metal magnetic particles. Following this, the metal magnetic particles having the silica film formed thereon, a resin composition containing a polyvinyl butyral (PVB) resin as a binder resin, and a toluene serving as a solvent were mixed to fabricate a mixture (slurry). Three types of resin compositions were provided, which include a resin composition only containing a binder resin, a resin composition containing a binder resin and a dimethoxydiphenylsilane, and a resin composition containing a binder resin and a methylsilsesquioxane. Accordingly, three types of slurries were made. Following this, each slurry was applied onto a PET film using an applicator and dried at a temperature of 80° C., so that a sheet of the magnetic material having a thickness of 60 to 70 μm was fabricated. Subsequently, the sheets of the magnetic material were stacked on one another and bonded together under a hydrostatic pressure of 6 ton/cm$^2$, so that a laminated body having a thickness of approximately 0.5 mm was fabricated. After this, a circular plate having an outer diameter of 8 mm was obtained by blanking from the fabricated laminated body, and the circular-plate-like laminated body was thermally treated at a temperature of 625° C. in a thermal treatment atmosphere containing nitrogen and oxygen for a duration of one hour. In this way, a magnetic base body was obtained. The thermal treatment was performed in eight types of thermal treatment atmospheres having different oxygen concentrations within a range of 10 ppm to 200 ppm, as listed in Table 1. As described above, the three types of slurries were used to fabricate laminated bodies, which were thermally treated within the eight types of thermal treatment atmospheres. As a result, 24 types of magnetic base bodies were obtained, which were identified as Samples 1 to 24. Subsequently, a silver paste was applied to the upper and lower surfaces of each sample shaped like a circular plate and dried, so that electrodes were formed. These electrodes were used to measure the volume resistivities of the samples. Table 1 shows the measured volume resistivities. The samples were examined with an X-ray diffraction apparatus by using a CuKα beam as the light source, applying voltage of 40 KV and scanning at a rate of 5°/min, to calculate ratios Ia/Ic, Ib/Ic and Ia/Ib. The ratio Ia/Ib is the ratio of Ia/Ic to Ib/Ic and referred to as the HM peak intensity ratio. Here, Ia denotes the integrated intensity of the peaks derived from the (220) plane of $Fe_2O_3$ (hematite), Ib denotes the integrated intensity of the peaks derived from the (104) plane of $Fe_3O_4$ (magnetite), and Ic denotes the integrated intensity Ic of the peaks derived from the (110) plane of αFe. Table 1 also shows the ratios Ia/Ic, Ib/Ic and the HM peak intensity ratio Ia/Ib of the samples calculated in the above-described manner. In the table, "Si Compound" means the Si compound contained in the resin composition that is mixed with the metal magnetic particles, "A" denotes dimethoxydiphenylsilane, and "B" denotes methylsilsesquioxane. The same results can be obtained when dimethoxydiphenylsilane is replaced with methyltrimethoxysilane and when methylsilsesquioxane is replaced with phenylsilsesquioxane, hydroxymethylsiloxane, hydroxyphenylsiloxane, or dimethylsiloxane.

TABLE 1

| Sample No. (CE: Comparative Example, WE: Working Example | Si Compound | Oxygen Concentration During Thermal Treatment (ppm) | $Fe_2O_3$ Intensity Ratio (Ia/Ic) | $Fe_3O_4$ Intensity ratio (Ib/Ic) | HM peak Intensity ratio (Ia/Ib) | Volume Resistivity (Ωcm) |
|---|---|---|---|---|---|---|
| 1(CE) | No | 10 | 0.9 | 0.2 | 4.50 | $2.30 \times 10^3$ |
| 2(CE) | No | 20 | 0.7 | 0.23 | 3.00 | $9.10 \times 10^2$ |
| 3(CE) | No | 35 | 0.6 | 0.4 | 1.50 | $6.00 \times 10^2$ |
| 4(CE) | No | 50 | 0.73 | 0.39 | 0.87 | $2.00 \times 10^2$ |
| 5(CE) | No | 80 | 0.5 | 0.3 | 1.67 | $9.10 \times 10^2$ |
| 6(CE) | No | 100 | 0.11 | 0.22 | 5.10 | $1.30 \times 10^3$ |
| 7(CE) | No | 150 | 0.3 | 1 | 0.30 | $8.50 \times 10^2$ |
| 8(CE) | No | 200 | 0.4 | 0.4 | 1.00 | $7.90 \times 10^2$ |
| 9(CE) | A | 10 | 0.07 | 0.07 | 1.00 | $1.80 \times 10^3$ |
| 10(CE) | A | 20 | 0.1 | 0.07 | 1.40 | $2.10 \times 10^3$ |
| 11(CE) | A | 35 | 0.12 | 0.04 | 3.00 | $1.50 \times 10^3$ |
| 12(CE) | A | 50 | 0.15 | 0.02 | 6.90 | $2.40 \times 10^3$ |
| 13(CE) | A | 80 | 0.16 | 0.03 | 5.33 | $3.20 \times 10^3$ |
| 14(CE) | A | 100 | 0.17 | 0.03 | 5.40 | $3.10 \times 10^3$ |
| 15(CE) | A | 150 | 0.18 | 0.03 | 6.00 | $6.80 \times 10^3$ |
| 16(CE) | A | 200 | 0.25 | 0.03 | 8.33 | $4.50 \times 04$ |
| 17(CE) | B | 10 | 0.1 | 0.03 | 3.33 | $2.80 \times 10^3$ |
| 18(CE) | B | 20 | 0.18 | 0.03 | 6.80 | $3.00 \times 10^3$ |
| 19(CE) | B | 35 | 0.24 | 0.02 | 9.90 | $1.20 \times 10^5$ |
| 20(WE) | B | 50 | 0.39 | 0.02 | 18.70 | $9.60 \times 10^5$ |
| 21(WE) | B | 80 | 0.44 | 0.02 | 22.00 | $8.60 \times 10^5$ |
| 22(WE) | B | 100 | 0.51 | 0.03 | 14.80 | $6.40 \times 10^5$ |
| 23(WE) | B | 150 | 0.66 | 0.02 | 33.00 | $7.00 \times 10^5$ |
| 24(WE) | B | 200 | 0.9 | 0.02 | 45.00 | $8.40 \times 10^6$ |

The measured volume resistivities of Samples 20 to 24 revealed that the HM peak intensity ratio Ia/Ib was 10 or more and the volume resistivity was high and exceeded $5.0 \times 10^5$ Ωcm when the laminated body fabricated using the slurry added with methylsilsesquioxane was thermally treated within the atmosphere having an oxygen concentration of 50 ppm or more. These results can be explained as follows. The Si—O framework contained in methylsilsesquioxane was preserved through the thermal treatment and surrounded the metal magnetic particles. Therefore, during the thermal treatment, Fe was not fed from the metal magnetic particles in the laminated body to the surface of the laminated body. As a result, on the surface of the laminated body, hematite ($Fe_2O_3$), which has an insulating property and contains a low proportion of Fe, was produced in a larger quantity than magnetite ($Fe_3O_4$), which contains a high proportion of Fe. In addition, the ratios Ia/Ic and Ib/Ic have finite values. This means that the oxide film formed on the surface of the laminated body is sufficiently thin to such an extent that the peaks derived from αFe can be detected. This is possibly because a reduced amount of Fe was fed from the inside of the laminated body and iron oxide is thus prevented from growing on the surface of the laminated body.

The measured results of Samples 17 to 19 showed that, although methylsilsesquioxane was added, the HM peak intensity ratio Ia/Ib was smaller than 10 and the volume resistivities were lower than those of Samples 20 to 24. This is possibly because the thermal treatment atmosphere used for the thermal treatment for Samples 17 to 19 has an oxygen concentration of 35 ppm or less and no sufficient amount of oxygen was accordingly fed to produce hematite on the surface of the laminated body during the thermal treatment.

As for Samples 1 to 8 obtained without addition of an Si compound and Samples 9 to 16 manufactured with addition of dimethoxydiphenylsilane as a Si compound, the HM peak intensity ratio Ia/Ib was smaller than 10 and the volume resistivity was significantly lower than that of Samples 20 to 24. This can be explained as follows. During the thermal treatment, no oxide phase having an Si—O framework, such as methylsilsesquioxane was formed around the metal magnetic particles. Accordingly, Fe was fed from inside of the laminated body to the surface of the laminated body during the thermal treatment, and, as a result, the oxide film formed on the surface of the magnetic base body, which results from the thermal treatment, has a high content of magnetite.

Advantageous effects of the above embodiments will be now described. The magnetic base body 10 relating to one embodiment described above includes the main body 50 that has the oxide phase 40 having an Si—O framework and the metal magnetic particles 30 bonded together via the oxide phase 40 and the oxide film 51 formed on the surface of the main body 50. The Si—O framework contained in the oxide phase 40 can prevent Fe from moving from the metal magnetic particles 30 inside the magnetic base body 10 to the surface of the magnetic base body 10. As a consequence, the oxide film 51 formed on the surface of the magnetic base body has a high content of hematite. In this way, the magnetic base body 10 can have a highly insulating surface without performing surface treatment after the thermal treatment. The above explanation applies to the magnetic base bodies 220, 310 and 410.

The method of manufacturing the magnetic base body 10 relating to one embodiment of the present invention includes steps of preparing the metal magnetic particles 30, mixing the metal magnetic particles 30 with a resin composition containing silsesquioxane or siloxane to produce a mixture, and thermally treating the mixture. The mixture is processed into a molded body. When the molded body is thermally treated, the Si—O structure contained in silsesquioxane or siloxane prevents Fe inside the molded body from moving to the surface of the molded body. As a result, the oxide film formed on the surface of the molded body resulting from the thermal treatment can have a high content of hematite. In the above-described manner, the magnetic base body 10 can have a highly insulating surface without the need of surface treatment following the thermal treatment. The above explanation applies to the magnetic base bodies 220, 310 and 410.

The dimensions, materials, and arrangements of the constituent elements described herein are not limited to those explicitly described for the embodiments, and these constituent elements can be modified to have any dimensions, materials, and arrangements within the scope of the present invention. Furthermore, constituent elements not explicitly described herein can also be added to the embodiments described, and it is also possible to omit some of the constituent elements described for the embodiments.

What is claimed is:

1. A magnetic base body comprising:

a main body including an oxide phase containing Si and a plurality of metal magnetic particles bound via the oxide phase; and an oxide film on a surface of the main body, the oxide film including magnetite and hematite, wherein Fe accounts for 98.5 wt % or more in the metal magnetic particles, and wherein, when an XRD diffraction pattern of the magnetic base body is observed, a ratio Ia/Ib is 10 or more, where Ia denotes an integrated intensity of peaks derived from the (220) plane of $Fe_2O_3$ and Ib denotes an integrated intensity of peaks derived from the (104) plane of $Fe_3O_4$.

2. The magnetic base body according to claim 1, wherein an average particle size of the metal magnetic particles is no less than 1 μm and no more than 10 μm.

3. The magnetic base body according to claim 1, wherein an insulating film is on a surface of the metal magnetic particles.

4. The magnetic base body of claim 1, wherein the metal magnetic particles are made of carbonyl iron.

5. An electronic component comprising the magnetic base body according to claim 1.

6. An electronic component comprising:

the magnetic base body according to claim 1; and a coil provided in the magnetic base body.

7. The magnetic base body of claim 1, wherein the oxide film surrounds the main body so as to define an outermost surface of the magnetic base body.

* * * * *